United States Patent [19]

Dalli et al.

[11] 4,305,523

[45] Dec. 15, 1981

[54] PUSH-IN CLOSURES

[75] Inventors: Allan G. Dalli, Warrandyte; Peter L. Revill, Middle Park, both of Australia

[73] Assignee: The Broken Hill Proprietary Company Limited, Melbourne, Australia

[21] Appl. No.: 175,497

[22] Filed: Aug. 5, 1980

[30] Foreign Application Priority Data

Aug. 13, 1979 [AU] Australia ..... PE0001

[51] Int. Cl.[3] ..... B65D 17/32

[52] U.S. Cl. ..... 220/268

[58] Field of Search ..... 220/268–273, 220/334

[56] References Cited

U.S. PATENT DOCUMENTS 4,128,186 12/1978 Gane ..... 220/268

4,134,517 1/1979 Rhoades ..... 220/268

4,155,480 5/1979 Defrenham et al. ..... 220/268

*Primary Examiner*—George T. Hall

*Attorney, Agent, or Firm*—Murray and Whisenhunt

[57] ABSTRACT

A push-in easy opening closure for a can end (1) or similar container member formed with a resealable pressure releasing tab (4) closing an opening (5) in the can end (1) and integrally connected to the can end (1) at integral connection (6). The tab (4) is adapted to be bent about the integral connection (6) during the opening operation, and to avoid sheet metal fracture at the integral connection (6), the radius about which the tab (4) will bend in the region of the connection (6) is artificially increased by some convenient means. In a first embodiment (FIGS. 1 to 3), a raised dimple (7) is formed centrally of the integral connection (6). In another embodiment (FIG. 4), an elongate raised bead (8) is formed longitudinally of the anticipated line of bending of the connection (6). In a still further embodiment (FIGS. 5 to 7), an elongate raised bead (9) extends transversely of the anticipated line of bending of the connection (6) and to either side of said line. In a still further embodiment (FIG. 9), an abutment (11) is secured or formed on the inner face of the can end (1) adjacent to the anticipated line of bending about the connection (6). In each of the embodiments, the bending radius of the tab (4) about the connection (6) is substantially increased to effectively prevent fracture of the tab (4) occurring.

12 Claims, 9 Drawing Figures

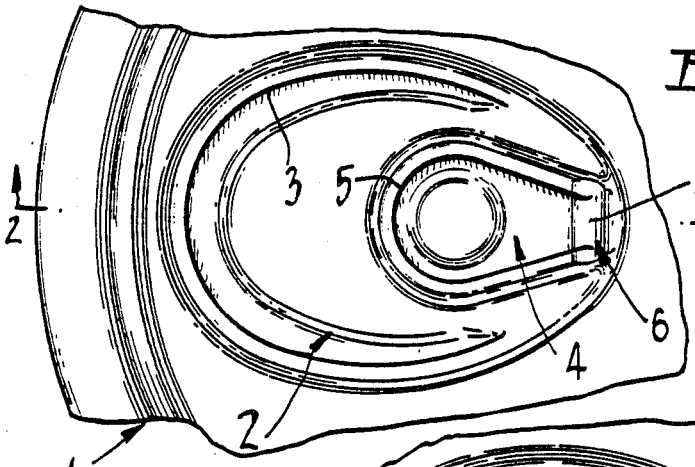
FIG. 4.
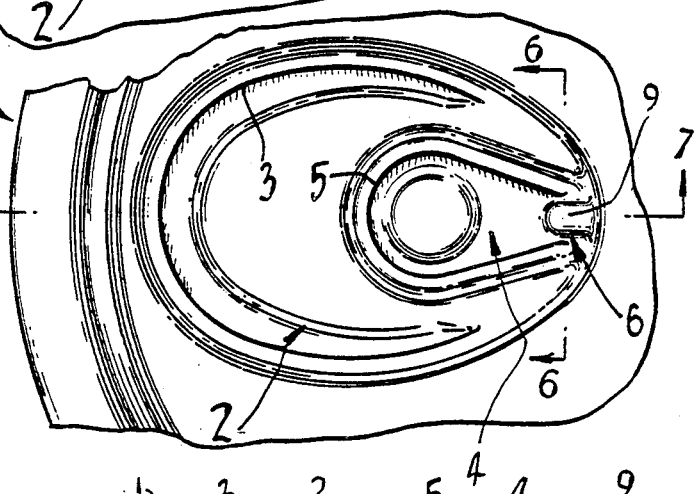
FIG. 5.
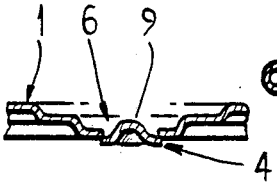
FIG. 6.
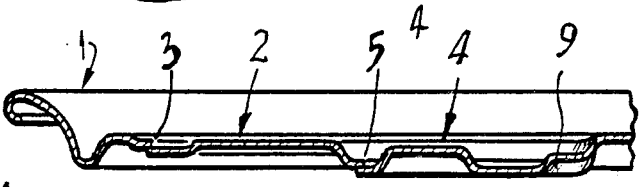
FIG. 7.
FIG. 8.
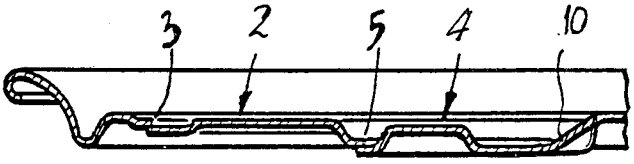
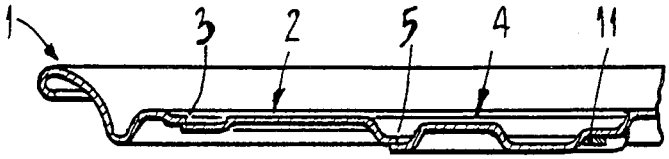
FIG. 9.

PUSH-IN CLOSURES

This invention relates to improvements in push-in easy opening closures, and more particularly, but not exclusively, to push-in easy opening closures of the general type described in our Australian Patent Application No. 35318/78 (incorporating provisional specifications PD 0416, PD 0848 and PD 1840), U.S. Pat. Nos. 4,105,134 and 4,155,480, and our Australian Patent Application No. 51529/79 the disclosures of which specifications are incorporated into this specification by cross-reference.

The closure combination of the type shown in FIGS. 17 to 23 of Australian Patent Application No. 35318/78 has been found to perform excellently under normal conditions of use, whether the can end is made from tin plate or aluminium. However, where the can end is made from aluminium and the larger push-in tab is excessively opened, for example such that the pressure releasing tab is bent back upon itself, the pressure releasing tab may fracture across the bending line or hinge so defined. While the layer of sealant covering the small tab at the line of bending prevents the small tab becoming detached from the can end, and while the bending of the larger tab in the above manner is likely to occur only to a limited extent, the possibility of the pressure releasing tab fracturing in this way may not be considered by some to be unacceptable.

It is the object of the present invention to provide an improved push-in easy opening closure in which the above problem is, for all practical purposes, overcome. While the present invention resulted from the above specific problem, the invention is of course equally applicable to the other pressure releasing closures disclosed in the Australian Applications and provisional specifications referred to above and, for that matter, to any other push-in easy opening closure where the possibility of hinge fracture, however remote, exists.

The invention therefore provides a push-in easy opening closure in a container member, comprising a push-in closure tab formed integrally from a portion of said container member and defined by at least a weakening line, said closure tab being integrally connected to said container member and about which said integral connection the closure tab is bent during the opening of said closure tab, characterised by means located at or near said integral connection which increases the effective bending radius of said integral connection when said closure tab is bent about said integral connection.

By increasing the effective bending radius the tensile stresses developed in the outer skin of the sheet metal or other material are reduced thereby significantly reducing the likelihood of fracture of the closure tab.

An increase in the effective bending or hinging radius may, in the case of a sheet metal can end or other container member, be achieved by forming a dimple, bead or other raised projection in the can end and extending across the anticipated line of hinging of said tab. Other means of effectively increasing the hinging radius are possible but the formation of a raised projection in the can end is seen as being the most practical from the manufacturing point of view although some means, such as an attachment to the inner face of the can end, may be less aesthetically obtrusive.

In its simplest and most preferred form, the can end or other container member is formed with an upwardly raised dimple having a diameter slightly smaller than the width of said connection and located centrally of said connection. The formation of a raised dimple in this region causes the tab to bend about the opposite portions of the periphery of the dimple which are parallel to the anticipated line of bending rather than about the natural radius generated by the sheet metal being folded upon itself. It will of course be appreciated that the provision of the dimple effectively increases the bending radius at least by the dimensions of the dimple.

In another embodiment, an elongate raised bead is formed coincident with the anticipated line of bending. Preferably, the raised bead extends into the portions of the can end to either side of the line of severance which defines the closure tab. In this case, the tab bends about the edges of the bead and once again effective enlargement of the bending radius is achieved.

In a still further embodiment, a raised bead is formed transversely of the anticipated line of bending with similar results.

Several embodiments of the invention will now be described with reference to the accompanying drawings in which:

FIG. 4 is a fragmentary plan view of a modified embodiment of the invention;

FIG. 5 is a fragmentary plan view of a further modified embodiment of the invention;

FIG. 6 is a fragmentary sectional end elevation taken along the line 6—6 in FIG. 5;

FIG. 7 is a fragmentary side elevation taken along the line 7—7 in FIG. 5;

FIG. 8 is a fragmentary sectional elevation similar to FIG. 7 showing a modified form of the embodiment shown in FIGS. 5 to 7 and FIG. 9 is a fragmentary cross-sectional elevation similar to FIG. 2 showing a final embodiment of the invention.

Figure 1:
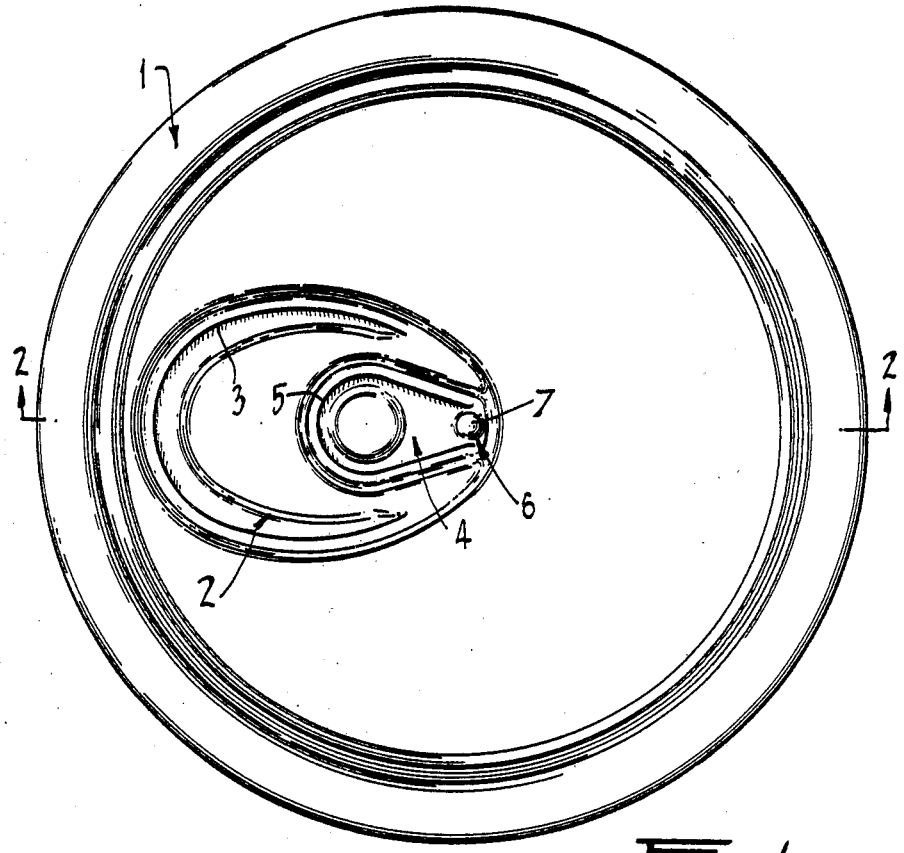
FIG. 1 is a fragmentary plan view of a can end having an improved push-in closure embodying the invention formed therein.
Figure 2:
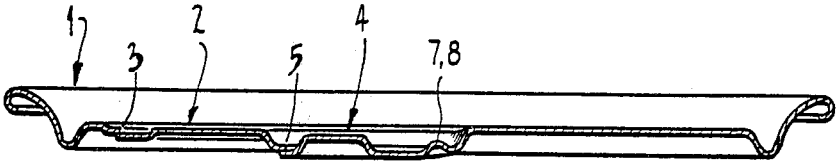
FIG. 2 is a fragmentary cross-sectional elevation taken along the line 2—2 in FIG. 1.
Figure 3:
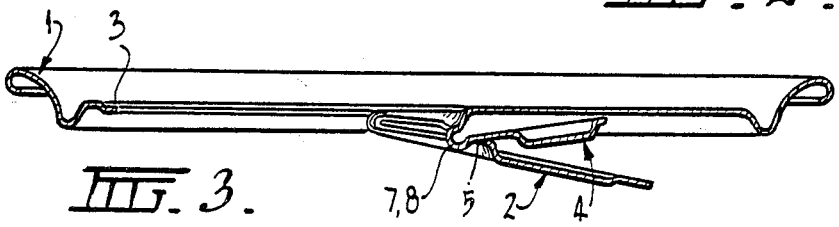
FIG. 3 is a similar cross-sectional elevation showing the push-in closures fully opened.

Referring firstly to FIGS. 1 to 3 of the drawings, there is shown a can end 1 formed with a push-in tab 2 closing a generally oblate pouring opening 3. A resealable pressure releasing tab 4 closing a generally tear-shaped opening 5 is located partly within the tab 2 and is integrally connected to the can end 1 at 6. The closure combination described above is in substance identical to the closure combination described in connection with FIGS. 17 to 19 of the specifications referred to above and since the physical construction and method of opening the closure combination is identical, further description thereof will not be provided in the present specification.

Under normal conditions of use in which the tab 2 is pushed inwardly of the can end to the position shown in FIG. 19 of the specifications referred to above, there is no possibility of either tab fracturing along their respective lines of bending. However, where the user mischievously or abusively pushes the tab 2 under the can end (as shown in FIG. 3 herein), the tab 4 may fracture at the connection 6 where the can end 1 is made from the usual grades of aluminium.

In order to prevent, for practical purposes, fracture of the tab 4 at the connection 6, the radius about which the tab 4 will bend in the region of the connection 6 is artificially increased by some convenient means, either provided at or formed in the region of the connection 6. In the embodiment of FIGS. 1 to 3 of the drawings, this is achieved by the formation of a raised dimple 7 located centrally of the connection 6. It has been found that a dimple formed by means of an hemispherical projection approximately 2 mm in diameter and approximately 0.6 mm in height prevents fracture of the connection 6 when the tab 2 is bent to the position shown in FIG. 3. As shown in FIG. 3, the tab 4 bends on either side of the dimple 7 and this effectively increases the bending radius severalfold.

In the embodiment shown in FIG. 4 of the drawings the dimple 7 is replaced by an elongate raised bead 8 extending longitudinally of the anticipated line of bending of the connection 6. This arrangement has the same cross-sectional elevation as the previous embodiment and increases the bending radius of the tab 4 at the connection 6 in exactly the same manner. It will be noted that the bead 8 extends to either side of the line of severance defining the opening 5.

In the embodiment shown in FIGS. 5 to 7, the dimple 7 is replaced by an elongate raised bead 9 extending transversely of the anticipated line of bending of the connection 6 and to either side of the line. The raised bead 9 may have the configuration shown in FIGS. 6 and 7 of the drawings or the upper surface thereof may be inclined as indicated by the reference numeral 10 in FIG. 8 of the drawings. In either case, the bending radius of the tab 4 about the connection 6 is substantially increased to effectively prevent fracture of the tab 4 occurring.

In the embodiment of FIG. 9 of the drawings the bending radius about the connection 6 is increased by the provision of an abutment 11 at the inner face of the can end adjacent the anticipated line of bending of the tab 4 about the connection 6. As the tab 4 is bent towards the position shown in FIG. 3, it will bend about the abutment 11 thereby effectively increasing the bending radius at the connection 6. The abutment 11 may comprise a small element of metal adhesively or otherwise secured to the can end or a raised area of hardened sealant or the like in the position shown.

While in each of the above embodiments the dimple or bead is upwardly domed, similar results may be achieved by a downwardly domed dimple or bead. Similarly, other projections or depressions of quite different shapes may be used provided the effective bending radius at the connection 6 is increased sufficiently to more evenly distribute the stress which occurs when the tab is bent in the manner shown in FIG. 3 of the drawings.

As mentioned above, the invention is not limited to the resealable pressure releasing tabs of the type described above and of the more general type described in the specifications referred to above. The invention is equally applicable to any push-in easy opening closure where it is desired that the likelihood of the tab fracturing at its line of hinging should be reduced.

Other advantages flow from the application of the present invention to pressure releasing closures of the type described above. One such advantage is that the formation of a dimple or bead at the connection of the pressure releasing tab to the can end is likely to increase the spring-back properties of the tab to thereby improve the operation of the tab in the manner described in U.S. Pat. Nos. 4,105,134 and 4,155,480. Similarly, the formation of a dimple or bead in the manner shown in the above embodiments increases the amount of sealant that will be applied to the can end in the region of the connection of the push-in tab to the can end and this will further improve the strength of the sealant in this region thereby increasing the security of attachment of the tab to the can end.

We claim:

1. A push-in easy opening closure in a container member, comprising a push-in closure tab formed integrally from a portion of said container member and defined by at least a weakening line, said closure tab being integrally connected to said container member and about which said integral connection the closure tab is bent during the opening of said closure tab, characterised by means located at or near said integral connection which increases the effective bending radius of said integral connection when said closure tab is bent about said integral connection.

2. The closure of claim 1, wherein said container member is formed from sheet metal and said means comprises a projection formed in the sheet metal defining said connection and extending across the anticipated line of bending of said closure tab.

3. The closure of claim 2, wherein said projection comprises a raised dimple having a diameter slightly smaller than the width of said connection and located centrally of said connection.

4. The closure of claim 2, wherein said projection comprises an elongate raised bead formed coincident with the anticipated line of bending of said closure tab.

5. The closure of claim 4, wherein said bead extends into the portions of the container member to either side of the closure tab.

6. The closure member of claim 4, wherein said bead extends transversely of and intersects the anticipated line of bending of said closure tab at said connection.

7. The closure of claim 6, wherein said closure is located within a depressed region of said container member and the upper surface of said bead extends at a downward inclination from said container member to said closure tab.

8. The closure of claim 1, wherein said means comprises an abutment on the inner face of said container member adjacent said connection and about which the closure tab bends when the closure tab is opened.

9. The closure of any one of the preceding claims, wherein said closure tab is severed from said container member except for said integral connection and is arranged in overlapping and underlying relationship with the aperture defined by the severing of said closure tab from said container member, and sealing material extending between at least the edge of said closure tab and said container member to hermetically seal said closure tab.

10. In a push-in easy opening closure in a container member, comprising a push-in closure tab formed integrally from a portion of said container member and defined by at least a weakening line, the closure tab being integrally connected to the container member by an integral connection about which the closure tab is bent during opening of the closure tab, the improvement comprising means located at or near the integral connection for increasing the effective bending radius of the integral connection during opening of the closure tab with bending of the closure tab about the integral connection.

11. A container member for use in a container for pressurized beverages, said container member including a push-in easy opening pouring closure and a smaller pressure releasing closure capable of being opened by push-in force, said pressure releasing closure being integrally connected to said container member by an integral connection about which the pressure releasing closure bends during opening, and means located at or near the integral connection for increasing the effective bending radius of the integral connection during opening of the pressure releasing closure.

12. In a container member for use in a container for pressurized liquid, said container member including a push-in easy opening pouring closure defined by at least a weakening line, and a smaller pressure releasing closure defined by at least a weakening line and capable of being opened by a push-in force, said pressure releasing closure being formed partly within said pouring closure and partly outside said pouring closure, said pressure releasing closure being arranged so as to be permanently opened when said pouring closure is opened to create an air venting passageway to assist in the venting of the contents of the container during pouring or drinking therefrom, wherein said pressure releasing closure is integrally connected to said container member and hinging about the integral connection during opening thereof, the improvement comprising means for increasing the effective bending radius of the integral connection during opening of the pressure releasing closure to prevent or reduce fracture of the integral connection upon opening of the pressure releasing closure and subsequent opening of the pouring closure with further displacement of the pressure releasing closure.

* * * * *